US005819562A

United States Patent [19]

Christ

[11] Patent Number: 5,819,562

[45] Date of Patent: Oct. 13, 1998

[54] DOOR LOCK HAVING MULTIPLE LOCKING BOLTS

[76] Inventor: Willy Christ, Stutzweg 6, CH-4254 Liesberg-Dorf, Switzerland

[21] Appl. No.: 858,493

[22] Filed: May 19, 1997

[51] Int. Cl.[6] ..... E05B 59/00

[52] U.S. Cl. ..... 70/107; 70/118; 292/34

[58] Field of Search ..... 70/107, 108, 110, 70/111, 113, 118, 120, 144, 150; 292/34–39

[56] References Cited

U.S. PATENT DOCUMENTS

| | | | |
|---|---|---|---|
| 1,535,210 | 4/1925 | Dyer | 70/118 X |
| 1,627,420 | 5/1927 | Thomas | 70/107 |
| 1,908,980 | 5/1933 | Heyel | 70/118 X |
| 2,094,369 | 9/1937 | Millice | 70/118 X |
| 3,266,276 | 8/1966 | Yulkowski | 70/110 |
| 4,322,958 | 4/1982 | Eigemeier | 70/107 |
| 4,481,796 | 11/1984 | Hamme | 70/107 |
| 4,962,653 | 10/1990 | Kaup | 70/107 |
| 5,027,625 | 7/1991 | Krachten | 70/107 |
| 5,265,920 | 11/1993 | Kaup et al. | 70/107 X |
| 5,495,731 | 3/1996 | Riznik | 70/108 |

*Primary Examiner*—Suzanne Dino Barrett
*Attorney, Agent, or Firm*—Erik M. Arnhem

[57] ABSTRACT

A door lock has four separate locking bolts operated or controlled by a single key-operated tumbler lock. The key-operated lock is located directly above two conventional external doorknobs, in a conventional arrangement, so that a would-be thief is unaware of the fact that the door lock contains four locking bolts, rather than the two locking bolts that are conventionally used. The four locking bolts achieve a level of security that is not attainable with the conventional two locking bolt arrangement.

5 Claims, 2 Drawing Sheets

DOOR LOCK HAVING MULTIPLE LOCKING BOLTS

BACKGROUND AND SUMMARY OF THE INVENTION

Door locks commonly include a single locking bolt controlled by a doorknob on each side of the door, and a second locking bolt controlled by a key-operated tumbler lock. The key-operated lock is accessible from one side of the door. In some cases a manual actuator is provided on the other side of the door for operating the second locking bolt without a key.

The present invention is concerned with a door lock that has four locking bolts instead of two locking bolts, as in conventional practice. The aim is to provide a greater degree of security than can be achieved with conventional lock sets.

In practicing the invention the lock mechanism is designed to have the outer appearance of a conventional lock set. The key-operated tumbler lock is located directly above one of the doorknobs for access from one side of the door (usually the exterior side). A turnable actuator is located on the other side of the door directly above the other doorknob. The lock assembly has the general appearance of a conventional lock assembly.

As noted previously, the lock mechanism has four separate locking bolts spaced at different locations along the edge of the door. All four locking bolts can be operated by a single key. The key-operated tumbler lock has drive connections to all four locking bolts.

Further features of the invention will be apparent from the attached drawings and description of an illustrative embodiment of the invention.

DESCRIPTION OF A PREFERRED EMBODIMENT OF THE INVENTION

Figure 1:
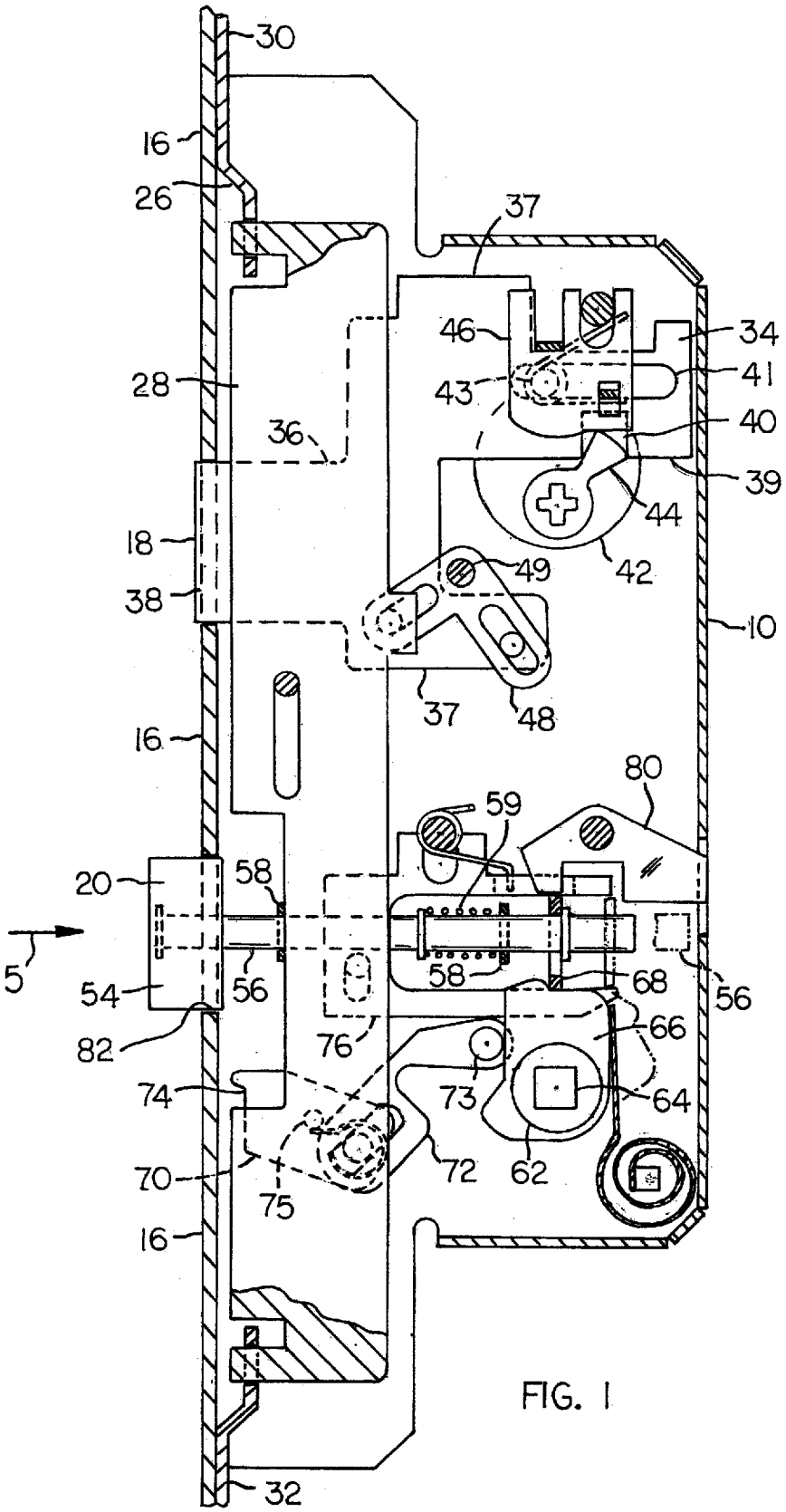
FIG. 1 is a fragmentary sectional view taken through a door lock embodying the invention.
Figures 2, 3, 4:
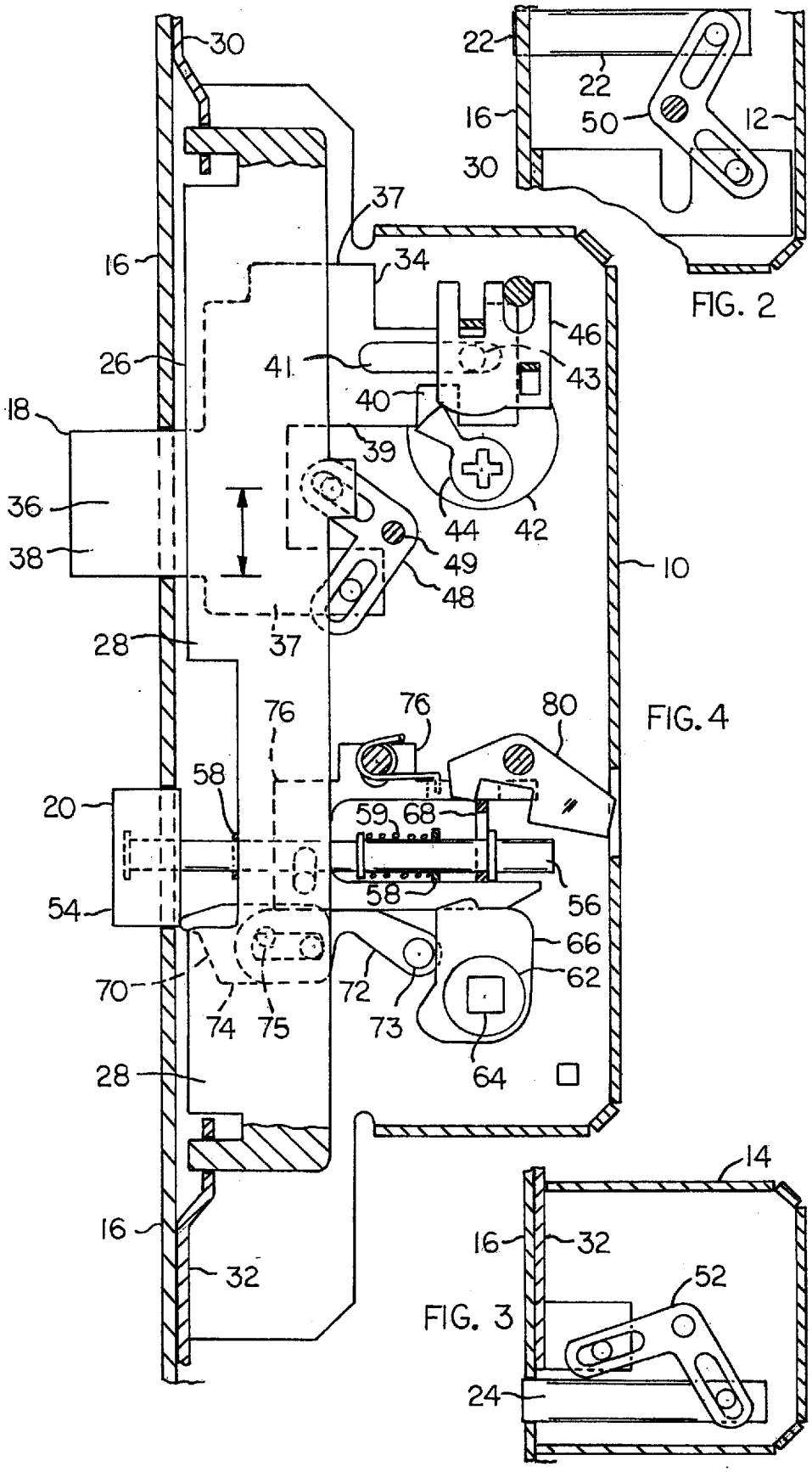
FIG. 2 is a fragmentary sectional view taken through an upper housing section linked to the main housing section depicted in FIG. 1.
FIG. 3 is a fragmentary sectional view taken through a lower housing section connected to the housing section shown in FIG. 1.
FIG. 4 is a view taken in the same direction as FIG. 1, but with a key-operated locking bolt in the locking condition.

The drawings show a door lock that comprises a multi-section lock housing insertable into three separate cavities cut, or otherwise formed, in the edge area of a door. Typically, the door will be an exterior door of a residence, apartment or motel room. The multi-section lock housing comprises a main housing section 10 (FIG. 1), an upper housing section 12 (FIG. 2), and a lower housing section 14 (FIG. 3). The three housing sections are linked together by a stiff metal plate 16 adapted to be secured to a vertical edge of the associated door. Each housing section 12, 14 or 10 is located within a separate cavity formed in the door edge. Plate 16 forms an elongated ornamental face plate overlying and concealing the housing sections 3 12, 14 and 10 within the door.

Main housing section 10 houses a first key-operated locking bolt 18 and a second doorknob-operated locking bolt

20. Upper housing section 12 houses a third locking bolt 22. Lower housing section 14 houses a fourth locking bolt 24. Locking bolts 18, 22 and 24 are linked together by a vertically slidable bolt actuator means 26 located in close proximity to elongated face plate 16. Bolt actuator means 26 comprises a central bar 28 located within main housing section 10, an upper link 30 extending from bar 28 into upper housing section 12, and a lower link 32 extending into lower housing section 14.

Referring specifically to the first locking bolt 18 (FIG. 1), the bolt comprises a heavy vertical plate 37 having an upper rear plate area 34 and a lower front plate area 36. Plate area 36 may include a relatively thick nose area 38 (transverse to the paper Plane) extending through a rectangular opening in face plate 16. FIG. 4 shows the locking bolt in its extended locking position.

Upper plate area 34 has a lower horizontal edge 39 and a cam slot 40 formed in said lower edge. A conventional key-operated tumbler lock 42 is mounted within the main housing section for operating the locking bolt between its extended position (FIG. 4) and its retracted position (FIG. 1). The key-operated tumbler lock comprises a swingable arm 44 extending into cam slot 40. A spring-biased positioner plate 46 can be used to releasably hold arm 44 against inadvertant movement. By comparing FIGS. 1 and 4, it will be seen that rocking motion of arm 44 causes the locking bolt 18 to move between its retracted position and its extended position. The bolt is guided partly by a guidance slot 41 movable on a fixed pin 43.

Locking bolt 18 is linked to central bar 28 by a bell crank 48 that has a pivot connection 49 with housing section 10. By comparing FIGS. 1 and 4 it will be seen that horizontal motion of locking bolt 18 produces vertical motion of bar 28 and the associated connector links 30 and 32. Bell cranks 50 and 52 form drive connections between links 30, 32 and locking bolts 22, 24, whereby locking bolts 18, 22 and 24 operate simultaneously between the retracted and locking positions.

Referring to locking bolt 20, the bolt comprises a generally non-symmetrical/rectangular nose piece 54 having a swivel fit on a support shaft 56. Nose piece 54 extends through a mating hole in face plate 16, whereby the nose piece is normally prevented from rotating around the axis of shaft 56.

Such rotation is employed only when it is intended to change the lock usage from a right-handed door swing to a left-handed door swing, or vice versa. By manually pulling the rectangular nose piece 54 out of the opening in face plate 16 it is possible to rotate the nose piece around the axis of shaft 56. This operation enables the nose piece to have a correct orientation relative to the associated keeper surface, irrespective of the direction of door swing.

Suitable guides 58 are provided for shaft 56, whereby the shaft can be moved horizontally to the right or to the left. A compression spring 59 encircles shaft 56 to normally bias the locking bolt to its locking position, as shown in FIG. 1. The locking bolt can be retracted by a doorknob suitably connected to a rotary barrel 62. A square hole 64 extends entirely through barrel 62 on the barrel rotational axis, whereby the square shaft of one or more external doorknobs is operatively connected to barrel 62.

Typically, there will be two external doorknobs, one on each side of the door, so that barrel 62 can be rotated from either the room side or the exterior side. Barrel 62 carries an arm 66 that registers with a plate 68 carried by shaft 56 of the locking bolt. Clockwise motion of barrel 62 retracts the locking bolt.

In preferred practice of the invention a bolt obstructing means 70 is linked to central bar 28 so that when the locking bolts 18, 22 and 24 are in their locked positions the second locking bolt 20 is automatically obstructed against movement from its locked position. The bolt obstructing means 70 can take various forms. As shown, the bolt obstructing means comprises a lever 72 pivotably attached at 73 to housing section 10 and a latch 74 having a pivot connection 75 with central bar 28. The lever and latch have a pin-slot connection with each other. It will be seen from the FIGS. 1 and 4 that when bolt actuator means 26 is moving upwardly to the FIG. 4 position the pin-slot connection between lever 72 and latch 74 causes the latch to turn toward the right surface of nose piece 54 so as to prevent play between lock bolt 20 and latch 74 in the FIG. 4 position.

In the FIG. 1 position of central bar 28 latch 74 is located below the path of nose piece 54. When bar 28 is moved upwardly to the FIG. 4 position the latch 74 projects into the path of nose piece 54. The locking bolt 20 is thus prevented from moving from its locking position. When key-operated lock 42 is rotated to the unlocked position (FIG. 1) bar 28 is moved down so that latch 74 no longer obstructs nose piece against retracting movement.

Lever 72 of the bolt obstructing means 70 has the added function of operating a U-shaped release mechanism 76 associated with locking bolt 20. The term "release" is here used to refer to a release or disconnection of the locking bolt from operating arm 66.

As shown in FIG. 1, the operating arm 66 is engaged with plate 68 on shaft 56, whereby swinging motion of the arm is- effective to move the shaft. Plate 68 is captively supported between the upper and lower arms of release mechanism 76, so that when the release mechanism is raised to the FIG. 4 position (by the lifting action of lever 72) plate 68 is located out of the path of arm 66. The associated doorknob (s) can be turned without affecting the condition of locking bolt 18. In this sense, the locking bolt is released from the doorknob actuated operator 62, 66.

The external appearance of the door lock mechanism is essentially the same as that of a conventional door lock. The key-operated lock 42 is located directly above the barrel 62, so that the external doorknobs have their normal (conventional) locations. Square hole 64 in barrel 62 enables standard doorknobs to be used with the door lock mechanism. The doorknobs are used to retract locking bolt 20 (but not the other locking bolts). When the doorknob is released spring 59 moves locking bolt 20 to its locking position. The retracted position of lock bolt shaft 56 is shown in dashed lines in FIG. 1.

The use of four locking bolts 18, 20, 22 and 24 enhances security beyond the conventional door locks that commonly use only two locking bolts. The four locking bolts are concealed within the various lock housing sections, so that a would-be thief is unaware of the fact that four locking bolts are being used.

Locking bolt 18 is designed so that nose area 38 is offset downwardly from rear plate area 34, so that it is difficult for a would-be thief to ascertain the exact location of the actuating mechanism 40, 44. Bell crank 48 is attached to an ear formed on plate area 36 so that the bell crank is essentially shielded by the nose piece from destructive attack.

A swingable safety latch 80 normally prevents locking bolt 20 from moving leftwardly beyond its locking position (FIG. 4). However, when it is desired to change the door lock from a right-handed door swing to a left-handed door swing, or vice versa, the safety latch is manually rotated clockwise from its FIG. 4 condition to permit the nose piece 54 to be separated from the associated opening 82 in face plate 16.

Figure 5:
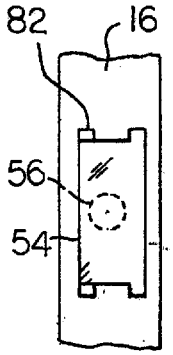
FIG. 5 is a fragmentary left end view of the FIG. 1 door lock taken in the direction of arrow 5 in FIG. 1.

Nose piece 54 can be rotated around the axis of shaft 56 to change the nose piece orientation relative to the associated keeper plate on the door frame, not shown. As shown in FIG. 5, the nose piece is generally rectangular but non-symmetrical. The associated guide opening 82 in plate 16 is configured to accept the nose piece in either rotated position of the nose piece.

What is claimed is:

1. A door lock comprising a lock housing insertable into a recess in the edge of a door;

said housing comprising a main housing section (10), an upper housing section (12), and a lower housing section (14);

a first key-operated locking bolt (18) located in said main housing section, said first locking bolt having a retracted position and a locking position projecting out of said main housing section; a key-operated means (44) for operating said first locking bolt between the retracted and locking positions;

a second doorknob-operated locking bolt (20) located in said main housing below said first locking bolt, said second locking bolt having a retracted position and a locking position projecting out of said main housing section; doorknob-operated means (62) for operating said second locking bolt to the retracted position, and a spring means (59) for operating said second locking bolt to the locking position;

a third locking bolt (22) located in said upper housing section; said third locking bolt having a retracted position and a locking position projecting out of said upper housing;

a fourth locking bolt (24) located in said lower housing section; said fourth locking bolt having a retracted position and a locking position projecting out of said housing section;

a vertically slidable bolt actuator means (26) extending within said housing in operative connection with said third and fourth locking bolts; said bolt actuator means having a raised position and a lowered position; said third and fourth locking bolts being in their retracted positions when said bolt actuator means is in the lowered position; said third and fourth locking bolts being in their locking positions when said bolt actuator means is in the raised position;

a drive connection (48) between said first locking bolt and said bolt actuator means, whereby movement of said first locking bolt to its locking position causes said bolt actuator means to move from its lowered position to its raised position;

a bolt obstructing means (70) linked to said bolt actuator means, said bolt obstructing means having an obstructing position preventing movement of said second locking bolt from its locking position; said bolt obstructing means having a non-obstructing position permitting movement of said second locking bolt between the locking position and the retracted position;

said bolt obstructing means being in the obstructing position only when said bolt actuator means is in the raised position.

2. The door lock of claim 1, and further comprising a release mechanism (76) for automatically releasing said second locking bolt from operative connection with said doorknob-operated means (62) when said bolt actuator means (26) is moved to the raised position.

3. The door lock of claim 1, wherein said bolt obstructing means comprises a lever (72) pivotally connected to said main housing section below said second locking bolt, a latch (74) pivotally connected to said bolt actuator means, and a pin-slot connection between said lever and said latch, whereby said latch has a turning motion toward said second locking bolt when said bolt actuator means approaches its raised position.

4. The door lock of claim 3, and further comprising a release mechanism (76) for automatically releasing said second locking bolt from operative connection with said doorknob-operated means (62) when said bolt actuator means is moved to the raised position; said second locking bolt having a shiftable plate (68) adapted to be contacted by said doorknob-operated means; said release mechanism having spaced arm means embracing said shiftable plate to move said plate out of the path of said doorknob-operated means when said bolt actuator means is moved to the raised position.

5. The door lock of claim 4, wherein said release mechanism is located in the path of said lever (72), such that said lever operates said release mechanism to a condition wherein said shiftable plate is out of the path of said doorknob-operated means.

* * * * *